US005555806A

United States Patent [19]

Nawrath

[11] Patent Number: 5,555,806

[45] Date of Patent: Sep. 17, 1996

[54] ROLLER ASSEMBLY IN AN INKING UNIT OR A DAMPING UNIT OF A ROTARY PRINTING MACHINE

[75] Inventor: Nikolaus Nawrath, Igenhausen, Germany

[73] Assignee: Man Roland Druckmaschinen AG, Offenbach am Main, Germany

[21] Appl. No.: 371,221

[22] Filed: Jan. 11, 1995

[30] Foreign Application Priority Data

Jan. 11, 1994 [DE] Germany ..... 44 00 563.6

[51] Int. Cl.[6] ..... B41F 7/40; B41F 31/36

[52] U.S. Cl. ..... 101/148; 101/352

[58] Field of Search ..... 101/348, 349, 101/350, 351, 352, 207–210, 216, 247, 147, 148

[56] References Cited

U.S. PATENT DOCUMENTS

| | | | |
|---|---|---|---|
| 2,751,843 | 6/1956 | Faeber . | |
| 2,892,399 | 6/1959 | Chase | 101/349 |
| 3,304,863 | 2/1967 | Jurny . | |
| 3,934,508 | 1/1976 | Heimlicher | 101/349 |

FOREIGN PATENT DOCUMENTS

| | | |
|---|---|---|
| 1240530 | 5/1967 | Germany . |
| 1561019 | 5/1970 | Germany . |
| 2249920 | 4/1973 | Germany . |
| 4140219 | 6/1993 | Germany . |

*Primary Examiner*—J. Reed Fisher
*Attorney, Agent, or Firm*—Cohen, Pontani, Lieberman, Pavane

[57] ABSTRACT

The invention provides a roller assembly including a roller for a damping unit or an inking unit in a rotary printing machine, which is supported relative to rollers via a pressure mechanism with springs, for example, a pressure spring and a leaf spring, so that the weight of the roller is balanced by the leaf spring. In this way, the roller has the same nip widths as the adjacent rollers. In addition, the roller is equipped with a holding mechanism, through which a bedding of the roller that has been set can be clamped, so that the roller has a fixed position during the printing process. The holding mechanism includes, for example, a pneumatic cylinder, a gripping lever or an adjusting screw.

9 Claims, 5 Drawing Sheets

ROLLER ASSEMBLY IN AN INKING UNIT OR A DAMPING UNIT OF A ROTARY PRINTING MACHINE

BACKGROUND OF THE INVENTION

1. Field of the Invention

The invention relates to a roller assembly that includes a roller which is supported on a roller bearing lever in a damping unit or an inking unit of a rotary printing machine, which roller can be pressed by a spring of a pressure mechanism against rollers lying adjacent to the roller and/or against a cylinder lying adjacent to the roller.

2. Description of the Prior Art

An inking unit in a rotary printing machine is already known from DE 22 49 920 C2 which has three inking rollers that lie adjacent to a form cylinder and are in contact with two distributor rollers, whereby two of the inking rollers lie adjacent to, respectively, one distributor roller each and the third inking roller lies adjacent to both distributor rollers. The bearing of one of the two distributor rollers is arranged via a roller bearing lever so as to be pivotable around the bearing of the transfer roller. The distributor roller presses two inking rollers, which are adjacent to the distributor roller, against the form cylinder under the influence of a spring. The inking rollers are also supported one under the other via springs. The adjustment of the contact area between the inking rollers, on the one hand, and the form cylinder, on the other, is performed via adjusting screws. This is meant to ensure an even, thin coating of ink on the form cylinder. However, adjusting the adjusting screws is expensive. A tool must be used to loosen the adjusting screws and then to tighten them again, while the given contact area between the rollers and the form cylinder in each particular case must be maintained. An adjustment procedure of this type is also very time-consuming. However, such a procedure is necessary, because the elastic surface of the rollers changes in diameter over time due to mechanical wear and to the chemical influences of ink and damping agents, requiring the roller to be readjusted repeatedly.

Another disadvantage of the known inking unit is that the inking rollers, due to their spring bedding, produce roller stripes on the form cylinder by swinging against it, which has a negative impact on print quality.

SUMMARY OF THE INVENTION

The object of the present invention is to provide a roller assembly an inking unit or a damping unit for a rotary printing machine in which the nip width, i.e., the contact area or squeeze area between one roller and the rollers lying adjacent to it or between the roller and a cylinder lying adjacent to it, can be automatically set, whereby it is possible to set equal nip widths between a roller and a first roller lying adjacent to it, on the one hand, and between the roller and a second roller lying adjacent to it or the cylinder, on the other hand.

Pursuant to this object, and others which will become apparent hereafter, one aspect of the present invention resides in a roller assembly having a base plate, a roller bearing lever, and a first spring for resiliently pressing the roller against at least one of the cylinder and the rollers lying adjacent to the roller. The first spring is detachably connected to the roller bearing lever. Furthermore, a holder holds the spring in place by clamping the roller bearing lever to the base plate. A second spring is arranged and adapted to balance the weight of the roller by one of tension and pressure on at least one of the cylinder and the rollers adjacent to the roller.

A particular advantage of the solution according to the invention is that the creation of roller stripes on the form cylinder is avoided, because the roller, i.e., the inking roller, is clamped during the ink application or the damping application.

In another embodiment of the invention, the first spring is part of pressing means which includes a pin connected to the base plate and a guide rod connected to the roller bearing lever and rotatably supported at the pin on the base plate. The first spring is a pressure spring arranged to surround the guide rod. The second spring is a leaf spring having a first end connected to a further pin rotatably connected to the base plate, and a second end that rests between two driving pins on the roller bearing lever.

In still another embodiment of the invention, an electric holding device supports the base plate in a pivotable manner so that the base plate can be positioned onto the cylinder and moved away from the cylinder. Alternatively, a fluid-pressurized working cylinder can be provided for pivotably supporting the base plate so that the base plate can be positioned onto the cylinder and moved away from the cylinder.

In yet a further embodiment of the invention, an additional fluid-pressurized working cylinder is provided so as to press the roller bearing lever against the base plate.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
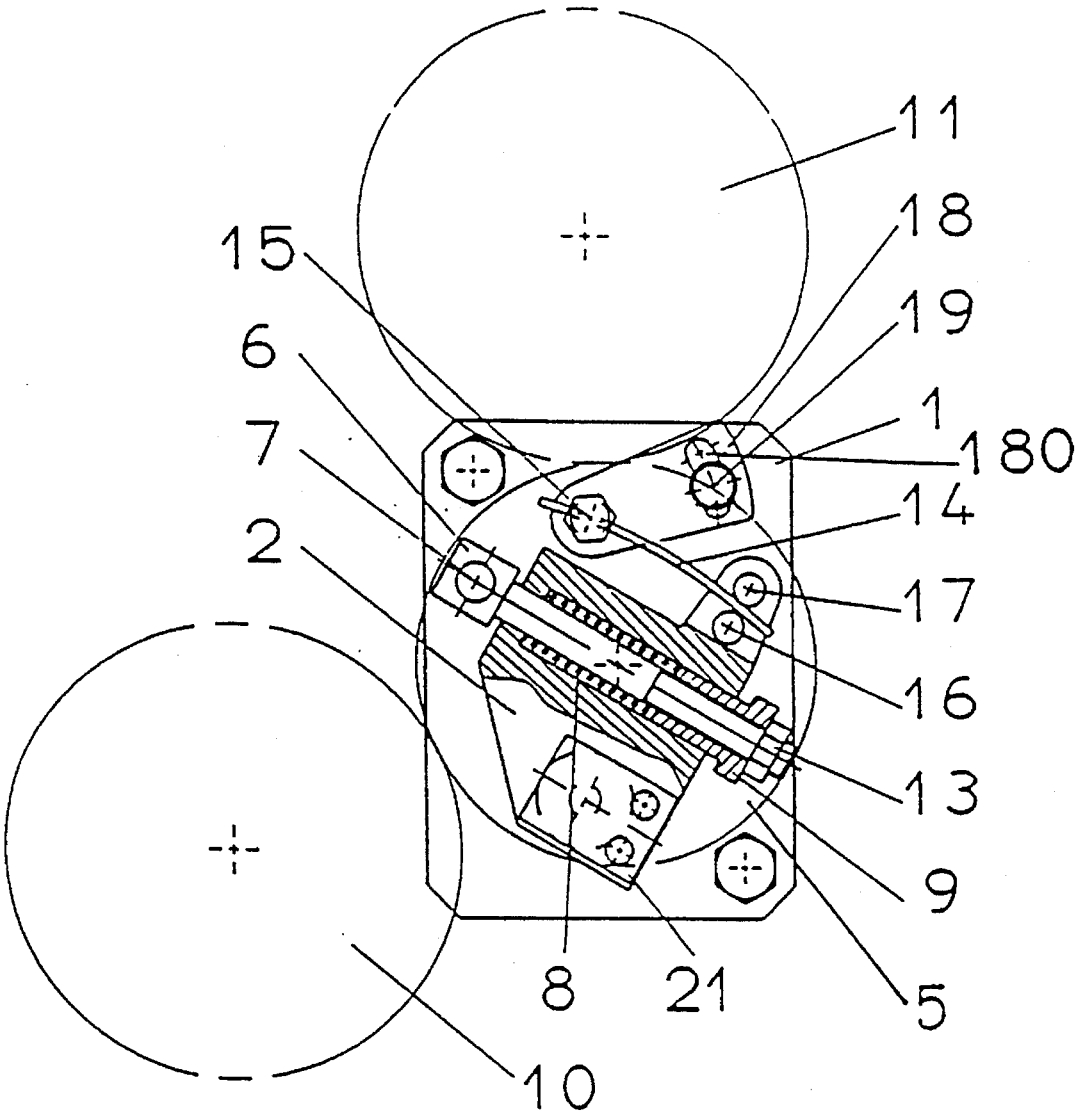
FIG. 1 is a top view of a roller bearing of a transfer roller which lies adjacent to two rollers, with a partial section.
Figure 4:
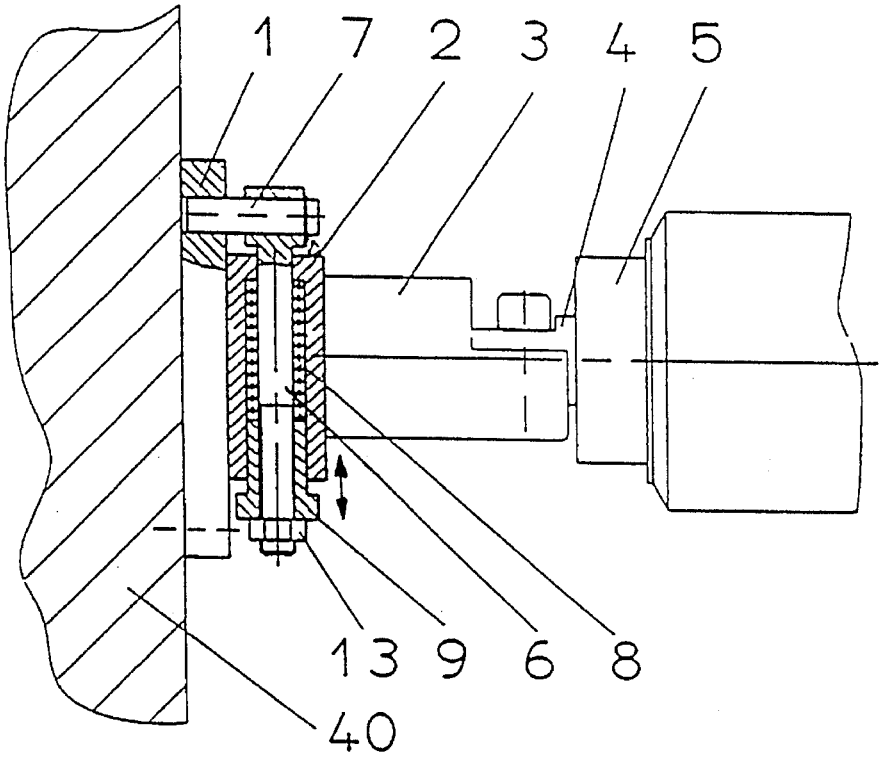
FIG. 4 is a side view of the roller bearing with a partial section and with a bearing shell which accommodates the roll spindle of an inking roller or a damping roller.

As shown in FIGS. 1 and 4, a roller bearing for a transfer roller 5 has a bearing lever 2 and a bearing shell 3. A roller spindle 4 for the transfer roller 5 is supported and fixed in the bearing shell 3.

A guide rod 6 (FIGS. 1, 4), which is linked to a pin 7 (FIG. 1), preferably in a rotatable fashion, runs through the roller bearing lever 2. The pin 7 is permanently connected to a base plate 1. The guide rod 6 is surrounded by a pressure spring 8, which is held in place by a threaded bushing 9 and presses the roller bearing lever 2 in the direction of the distributor cylinders 10, 11, whereby the roller 5 is simultaneously pressed against the distributor cylinders 10, 11. The correct pressure point for given nip widths between the transfer roller 5, on the one hand, and the distributor rollers 10, 11, on the other hand, is set by compressing the pressure spring 8 via the threaded bushing 9. This is done by twisting on the guide rod 6. After the spring force has been set, the threaded bushing 9 is secured against turning by a counter-nut 13.

Figure 6:
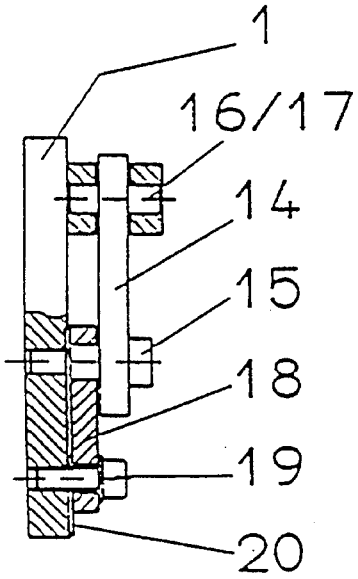
FIG. 6 is another side view of the roller bearing, with a partial section, in conjunction with a leaf spring and a clamping lever.

In order to be able to adjust the nip widths between the transfer roller 5 and the distributor roller 10, as well as those between the transfer roller 5 and the distributor roller 11, to be the same, which must be done because of the arrangement of the transfer roller 5 relative to the distributor rollers 10 and 11, another spring, leaf spring 14, is provided. The leaf spring 14 is secured on one side in a pin 15, which is located in rotatable fashion in the base plate 1. The free end of the leaf spring 14 extends out between two driving pins 16, 17, which are in turn connected to the roller bearing lever 2 (cf. FIG. 6). A clamping lever 18 is permanently connected to the pin 15. By turning the clamping lever 18, it is possible to change the nip widths between the transfer roller 5 and the distributor rollers 10, 11. In the design shown in FIG. 1, the weight of the transfer roller 5 acts upon the distributor roller 10. By fixing the clamping lever 18 in place and then pressing the transfer roller 5 onto the distributor roller 11 by means of the leaf spring 14, the nip widths can be precisely set. By turning the leaf spring 14, the weight of the transfer roller 5 can be fully balanced when the spring force of the leaf spring 14 corresponds exactly to the weight of the transfer roller 5. When the weight is balanced, the pressure spring 8 presses the transfer roller 5 evenly against the distributor rollers 10, 11, and equal nip widths result. Subsequently, the clamping lever 18 is screwed securely to the base plate 1 with a screw 19 located in an elongated hole 180. In order to maintain the best possible adhesion between the clamping lever 18 and the base plate 1, the clamping lever 18 is provided on its underside 20 with a granular or hard surface. Correspondingly, the base plate 1 may also have a granular or gritty surface or a hard surface. After this setting has been carried out, the transfer roller 5 is clamped during printing. The base plate 1 for the transfer roller 5 is screwed securely to, for example, the wall of the printing group 40 (FIG. 4).

Figure 2:
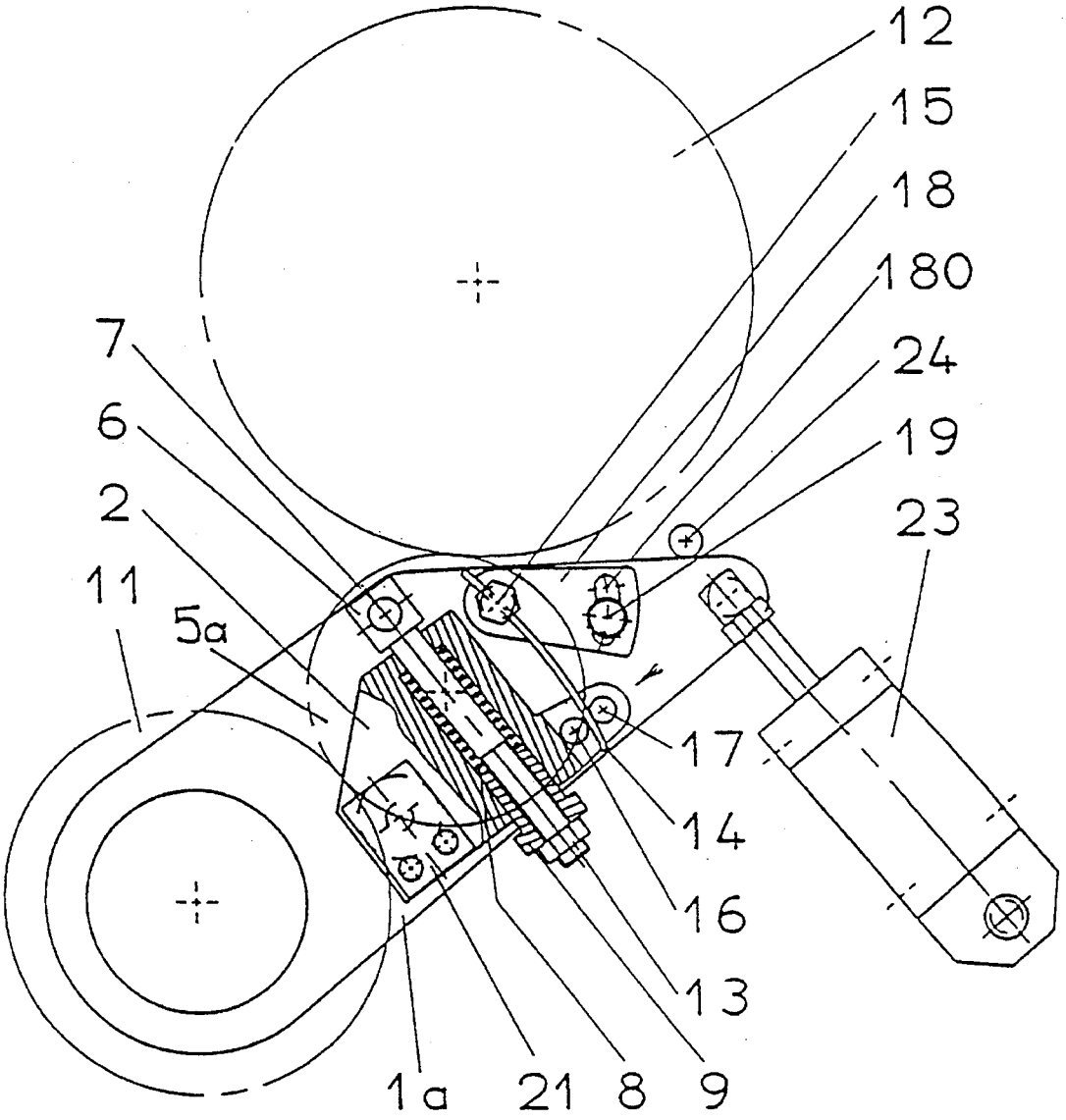
FIG. 2 is a top view of a roller bearing of an inking roller, with a partial section, showing the inking roller positioned on a form cylinder.
Figure 3:
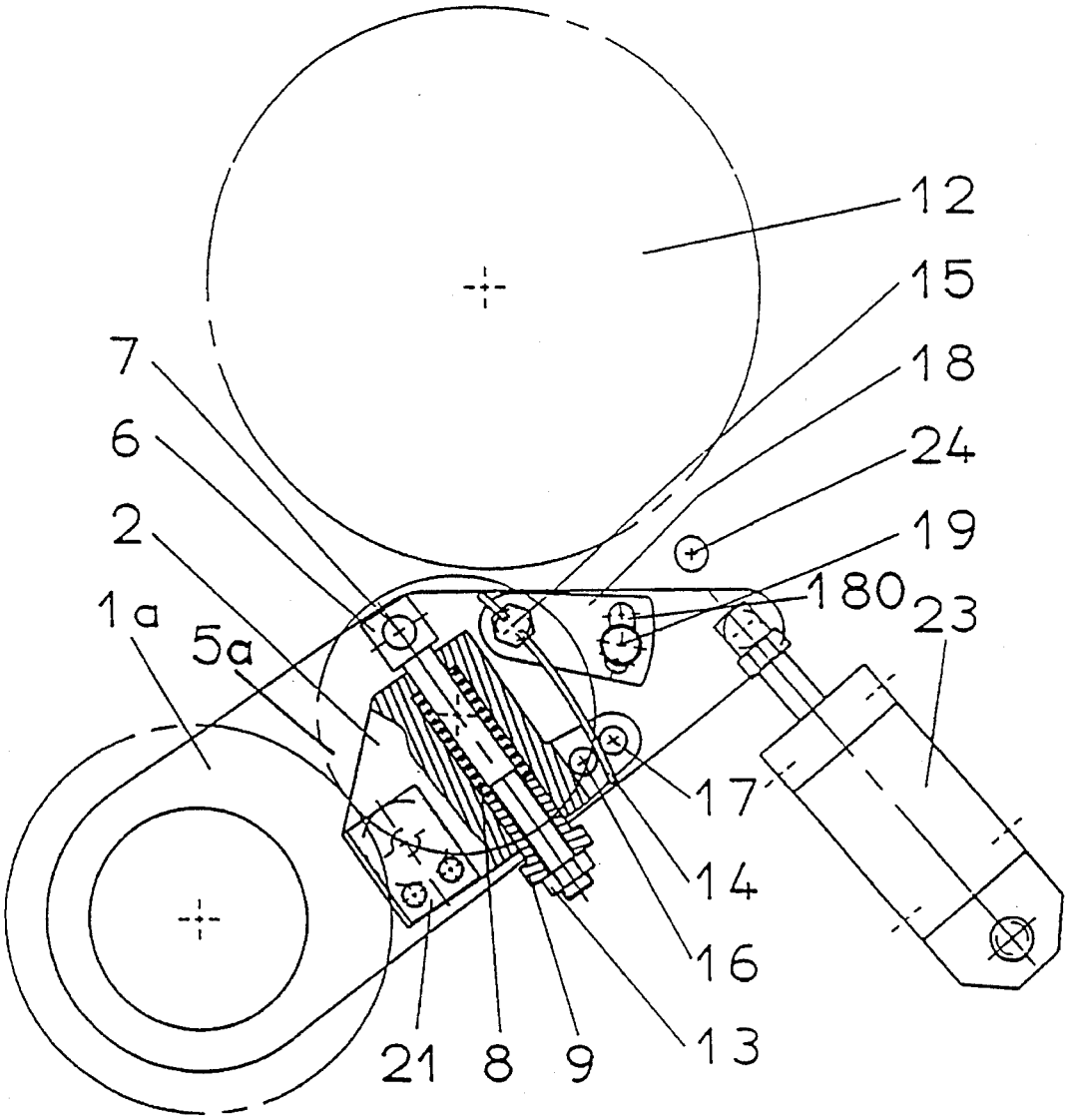
FIG. 3 is a view similar to FIG. 2, with the inking roller moved away from the form cylinder.

Like the transfer roller 5 (cf. FIG. 4), an inking roller **5*a* (FIG. 2) is connected to the roller bearing lever 2 via a roller spindle 4 and a bearing shell 3. The inking roller 5*a* is attached to a base plate 1*a* in the same manner as the transfer roller 5 is attached to the base plate 1. However, the base plate 1*a*, in contrast to base plate 1, is supported in a rotatable fashion on the bearing of the distributor roller 11 and during printing is pressed firmly against a stop 24 by means of a pneumatic cylinder 23. In this way, the inking roller 5*a* is positioned against a form cylinder 12. Because the base plate 1*a* is rotatably supported on the distributor cylinder bearing, contact between the inking roller 5*a* and the distributor roller 11 is maintained even when the inking roller 5*a* is moved away from the form cylinder 12**.

Figure 5:
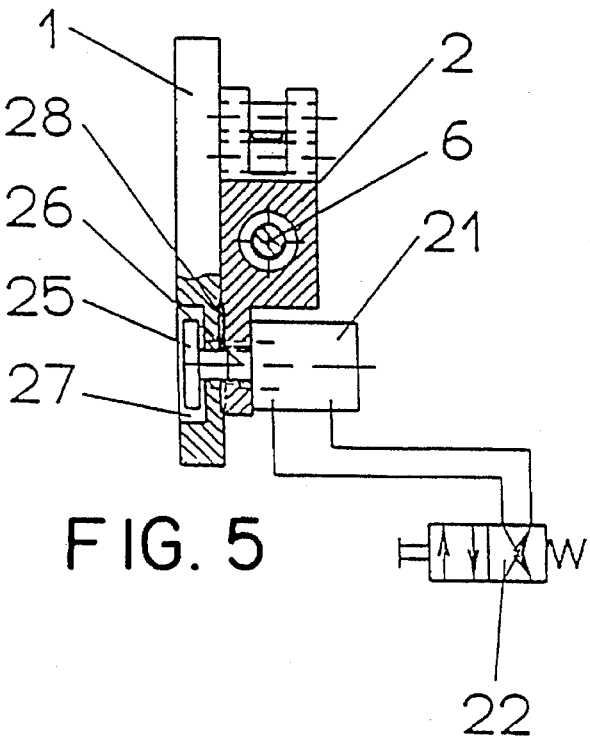
FIG. 5 is another side view of the roller bearing, with a partial section, in conjunction with a pneumatic locking mechanism.

When the nip width between the inking roller **5*a* and the distributor roller 11 and the nip width between the inking roller 5*a* and the form cylinder 12 are to be set, the movable base plate 10*a* is first pressed against the stop 24, and only then is the roller bearing lever 2 clamped to the base plate 1 via a pneumatic cylinder 21 (FIG. 5), which is also located on the base plate 1 of the transfer roller 5. The pneumatic cylinder 21 has a piston with a piston rod 26 attached to the piston and a flange bearing pin 25 attached to the end of the piston rod 26. In its extended state, the flange bearing pin 25 reaches freely into a recess 27 on the base plate 1 or 1*a*. The recess 27 has, for example, a shape like that of the long hole 180. The bearing surface of the roller bearing lever 2 in the area of the flange pin 25 is provided with a granular and hard surface 28. The pneumatic cylinder 21 is responsible for holding the roller bearing lever 2 onto the base plate 1 or 1*a* by a friction connection. The pneumatic cylinder 21 thus serves as a clamping device between the roller bearing lever 2 and the base plate 1 or 1*a*. The fact that the pneumatic cylinder 21 can be easily detached makes it possible, whenever necessary, e.g., due to wear on the outer surfaces of the transfer roller 5 or the inking roller 5*a*, to automatically readjust the contact pressure between the transfer roller 5 or the inking roller 5*a* on the distributor rollers 10, 11 or the distributor roller 11 and the form cylinder 12 by loosening the flange bearing pin 25 from the base plate 1 or 1*a*. In order to control the pneumatic cylinder 21, there is a manual or an electromagnetic valve 22**.

Figure 7:
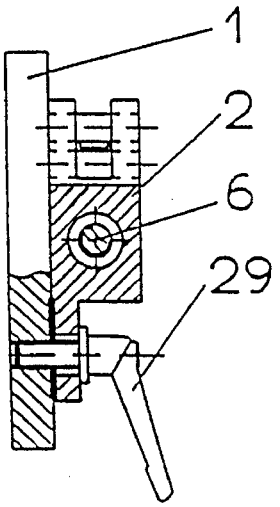
FIG. 7 is a side view of a mechanical holding mechanism for a roller, with a partial section.
Figure 8:
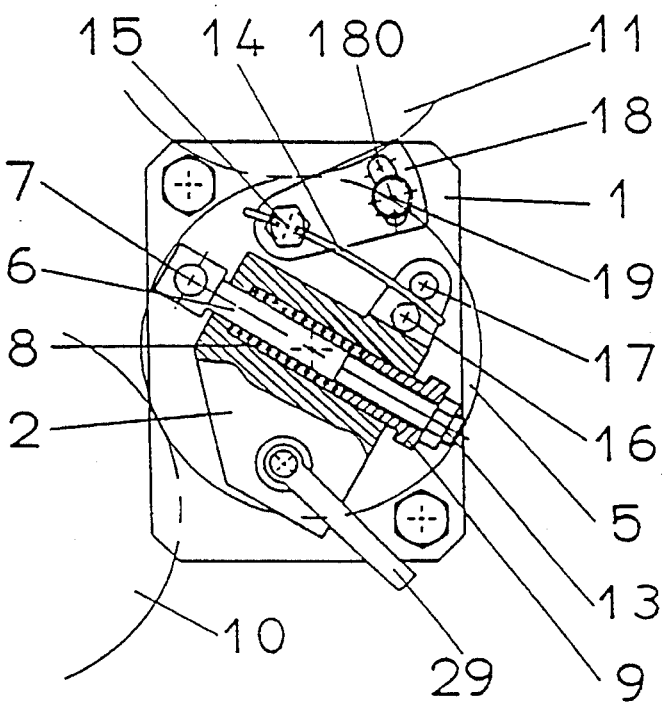
FIG. 8 is a front view of the mechanical holding mechanism in conjunction with the roller bearing, with a partial section.
Figure 9:
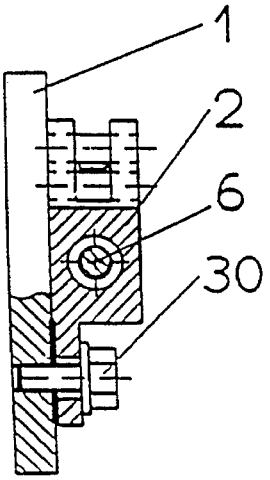
FIG. 9 is a side view of another mechanical holding mechanism of a roller, with a partial section.
Figure 10:
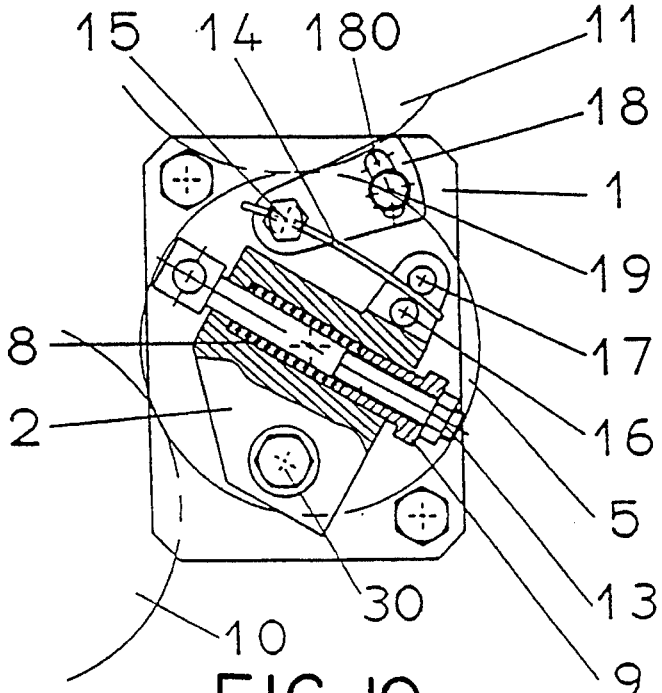
FIG. 10 is top view of the mechanical holding mechanism for a roller as in FIG. 9, with a partial section.

Instead of the pneumatic cylinder 21, other means can also be used as holding mechanisms between the roller bearing lever 2 and the base plate 1 or **1*a*. For example, a quick gripping lever 29 in (FIGS. 7, 8) is suitable for this purpose. Those, skilled in the art will readily understand how such a quick gripping lever is constructed. Another alternative is a screw 30 (FIGS. 9, 10). Instead of the pneumatic cylinder 21, 23**, other fluid-pressurized working cylinders or electrical holding mechanisms are also suitable.

The invention provides a roller 5, **5*a* for a damping unit or an inking unit in a rotary printing machine which is supported via a pressure mechanism by springs, for example, by a pressure spring 8 and a leaf spring 14, on rollers 10, 11 which lie adjacent to the roller 5, 5*a* or a roller 11 which lies adjacent to the roller 5, 5*a* and a form cylinder 12. According to the invention, the leaf spring 14 serves to balance the weight of the roller 5, 5*a*. The latter is equipped with a holding mechanism by means of which the bedding of the roller 5, 5*a* that has been set can be clamped, so that the roller 5, 5*a* has a fixed position during the printing process. The holding mechanism has, for example, a pneumatic cylinder 21, a gripping lever 29 or an adjusting screw 30. By loosening the holding mechanism after the outer surface of the roller 5, 5*a*** has become worn, the resilient bedding readjusts itself. The holding mechanism is then clamped tight again.

The invention is not limited by the embodiments described above which are presented as examples only but can be modified in various ways within the scope of protection defined by the appended patent claims.

I claim:

1. A roller assembly for damping and inking units of rotary printing machines, comprising:

a roller;

a base plate;

a bearing lever, the roller being mounted to the bearing lever;

a guide rod connected to the bearing lever and having a longitudinal axis;

a first pin connected to the base plate and one end of the guide rod so that the guide rod and bearing lever can pivot relative to the base plate;

first spring means for moving the roller back and forth along the axis of the guide rod, the first spring means including a pressure spring that surrounds the guide rod;

second spring means for moving the roller substantially perpendicular to the guide rod axis, the second spring means including a leaf spring having a first end and a second end;

a second pin rotatably mounted to the base plate, the first end of the leaf spring being connected to the second pin so as to be rotatable therewith;

two driving pins connected to the bearing lever so as to be next to one another, the second end of the leaf spring being arranged between the two driving pins so that the second end of the leaf spring can move the bearing lever relative to the base plate; and means for releasably clamping the bearing lever to the base plate.

2. A roller assembly as defined in claim 1, and further comprising means for pivoting the base plate relative to a frame of a rotary printing machine.

3. A roller assembly as defined in claim 2, wherein the pivoting means includes a working cylinder having a piston rod connected to the base plate and a cylinder member connectable to the rotary printing machine.

4. A roller assembly as defined in claim 1, wherein the clamping means includes a fluid-pressurized working cylinder connected to the roller bearing lever and the base plate so as to press the roller bearing lever against the base plate.

5. A roller assembly as defined in claim 1, wherein the clamping means includes a quick-gripping lever connected to the roller bearing lever and the base plate whereby the roller bearing lever is releasably connected to the base plate.

6. A roller assembly as defined in claim 1, wherein the clamping means includes a screw that releasably connects the roller bearing lever to the base plate.

7. A roller assembly as defined in claim 1, wherein the roller bearing lever has a roughened surface that faces the base plate.

8. A roller assembly as defined in claim 1, and further comprising:

a clamping lever having a roughened surface area, the clamping lever being fixed to the second pin so that the roughened surface area faces the base plate and so that the clamping lever rotates with the second pin; and means for selectively securing the clamping lever so that the second pin does not rotate and the leaf spring does not move.

9. A roller assembly as defined in claim 1, wherein the guide rod has a threaded end, and further comprising a threaded bushing mounted to the threaded end of the guide rod, the pressure spring having one end that engages the threaded bushing, and another end that engages the bearing lever.

* * * * *